US006341561B1

(12) United States Patent
Imamaki et al.

(10) Patent No.: US 6,341,561 B1
(45) Date of Patent: Jan. 29, 2002

(54) STAMP UNIT AND METHOD OF MANUFACTURING THE STAMP UNIT

(75) Inventors: Teruo Imamaki, Nagoya; Minoru Yamamoto, Yokkaichi, both of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/430,288

(22) Filed: Oct. 29, 1999

(30) Foreign Application Priority Data

Oct. 30, 1998 (JP) ..... 10-310874

(51) Int. Cl.[7] ..... B41C 1/06
(52) U.S. Cl. ..... 101/483; 101/327
(58) Field of Search ..... 101/483, 484, 101/368, 473, 327, 333

(56) References Cited

U.S. PATENT DOCUMENTS

| | | | | | |
|---|---|---|---|---|---|
| 5,595,112 | A | * | 1/1997 | Seo | 101/333 |
| 5,611,279 | A | * | 3/1997 | Ando et al. | 101/333 |
| 5,741,459 | A | * | 4/1998 | Ando et al. | 101/333 |
| 5,858,298 | A | * | 1/1999 | Humal | 264/413 |
| 5,873,308 | A | | 2/1999 | Taira | 101/327 |
| 6,030,743 | A | * | 2/2000 | Okumura et al. | 430/203 |

FOREIGN PATENT DOCUMENTS

EP 0 810 100 A1 12/1997

* cited by examiner

*Primary Examiner*—John S. Hilten
*Assistant Examiner*—Anthony H. Nguyen
(74) *Attorney, Agent, or Firm*—Oliff & Berridge, PLC

(57) ABSTRACT

A stamp unit comprising a holding unit, and a method of manufacturing a stamp unit, comprising, holding a stamp material in the holder member to create a holding unit; positioning the holding unit in a stamp manufacturing device so that the holding unit is disposed between a presser unit and an irradiation unit of the stamp manufacturing device; and pressing the holding unit by means of the presser unit so as to force a surface of the stamp material against the irradiation unit to form a desired image on a surface of the stamp material when irradiated by the irradiation unit to thereby create a stamp surface. The height of the holder member is selected in proportion to a size of the stamp material to provide a uniform pressure on the holding unit irrespective of the size of the stamp material. When the holding unit is pressed in the presser unit, a reaction force works on portions of the presser unit and the irradiation unit in proportion to the stamp material size. The reaction force causes portions of the presser unit and irradiation unit to bend. Thus, the height of the holding unit is selected in proportion to the stamp material size so as to absorb the bending or to increase the amount of pressure. Thus, the stamp material can be pressed uniformly in the stamp manufacturing device regardless of the stamp material size ensuring a good quality manufactured stamp surface.

19 Claims, 20 Drawing Sheets

12 × 12=144mm²

20 × 20=400mm²

30 × 30=900mm²

40 × 40=1600mm²

10 × 60=600mm²

14 × 38=532mm²

18 × 50=900mm²

22 × 60=1320mm²

STAMP UNIT AND METHOD OF MANUFACTURING THE STAMP UNIT

BACKGROUND OF THE INVENTION

1. Field of Invention

The invention relates to a stamp unit and method of manufacturing a stamp unit having a holding unit which holds a stamp material. The stamp unit is positionable in a stamp manufacturing device where the holding unit is pressed while a stamp is manufactured from the stamp material. More specifically, the invention relates to providing a uniform pressure applied to a stamp material during manufacture regardless of the size of the stamp material.

2. Description of Related Art

The conventional stamp unit comprises a grip, a holder and a skirt member. The holder member is connected to the grip member, and is capable of moving vertically within the skirt member. The stamp material is thermally adhered to a lower end portion of the holder member. In such a conventional stamp unit, the stamp material is formed of two layers. The lower layer is made of a soft porous resin formed with a light energy absorption material, such as carbon black, dispersed therein. The upper layer, which supplies ink to the lower layer and is capable of pressing the lower layer uniformly, is made of a hard porous resin.

In the case of manufacturing a stamp, a roll-shaped transparent film is transported into the stamp manufacturing device. Then, character and image data is printed by a thermal head and ink transfer ribbon onto the transparent film to create a positive original film. The holder member is placed into the stamp manufacturing device so that the positive original film and the stamp material oppose each other with a transparent acrylic plate between them. When an irradiation unit, such as a xenon tube, emits light, the lower layer of the stamp material is illuminated or exposed through the positive original film. Only the portion which is illuminated through the non-printed or transparent portion of the positive original film is melted and solidified by the heat generated by the light energy absorption material that is, the carbon black, to create a seal so that ink does not permeate. On the other hand, the portion which is not illuminated, melted or solidified forms an image, such as the characters and symbols on the positive original film. Thus, the stamp is manufactured on the lower layer, and contains sealed and unsealed portions according to the desired pattern.

An ink pack is stored in an ink pack storing portion within the holder member. The ink pack storing portion has an uneven bottom formed in a lattice shape. The ink pack is opened when it is sandwiched and pressed between the uneven bottom and a plate attached to the grip member, by moving the grip member downward. Ink flowing from the ink pack is stored in the upper and lower layers of the stamp material. The ink flows out from the unsealed portion, but does not flow out from the sealed portion.

In the case of printing characters using the stamp unit, the grip member is moved downward to place the skirt member at the desired position on a printing sheet. The grip member moves the holder member downward within the skirt member so that the stamp material is pressed against the printing sheet. Ink attaches to the printing sheet through the unsealed portion of the stamp material so that various kind of images, such as characters and symbols, can be printed.

As described above, the stamp unit, including the holding unit, the skirt member and the grip member, are placed in the stamp manufacturing device where the holding unit is pressed while a stamp is manufactured. In such a case, it is necessary to provide a holding unit storing portion which can store the holding unit. Accordingly, it is necessary to provide enough space to insert the various members associated with the stamp unit.

Therefore, a stamp unit has been proposed, wherein only the stamp material and the holder member are placed into the stamp manufacturing device. After a stamp is manufactured with the stamp manufacturing device, the holder member which holds the stamp material, is inserted into the skirt member and attached to the grip member so as to be movable vertically within the skirt member.

Such a stamp manufacturing device has an irradiation unit on which the holding unit comprising at least the stamp material and the holder member is placed. A presser unit comprising a lid encloses the holding unit within the stamp manufacturing device, and presses the holding unit, and in particular the stamp material, at a predetermined position onto the irradiation unit, when the lid is closed.

However, in the conventional device, the holding unit that is placed into the stamp manufacturing device has a fixed height regardless of the stamp material size. However, the stamp material has to be pressed uniformly onto the irradiation unit while a stamp is being produced. When the holding unit is placed into the stamp manufacturing device and the lid is closed, the holding unit is pressed against the irradiation unit. A reaction force then acts on the irradiation unit and the presser unit in proportion to the stamp material size. A large reaction force causes portions of the irradiation unit and the presser unit to bend. This bending leads to a reduction in the pressure urging the stamp material against the irradiation unit, reducing the image quality of the manufactured stamp.

SUMMARY OF THE INVENTION

Therefore, it is an object of the invention to solve the above-mentioned problem, and to provide a method of manufacturing a stamp unit where the pressure on a stamp material is uniform regardless of the size of the stamp material where a holding unit having a holder member holds the stamp material, and the holding unit is placed into a stamp manufacturing device and pressed to manufacture a stamp from the stamp material.

In order to accomplish the object of the invention, the height of the holding unit is heightened in proportion to the stamp material size. That is, even if the stamp material is pressed with a fixed pressure, the reaction force differs according to the stamp material size. In response to the reaction force, portions of an irradiation unit and a presser unit bend in proportion to the reaction force.

By changing the height of the holding unit, the stamp material can be pressed uniformly onto an irradiation unit because the bending of the presser unit and irradiation unit is eliminated.

Preferably, the stamp material of the stamp unit comprises an elastic and transformable soft porous resin having a light energy absorption material at a lower end portion. The elastic and transformable soft porous resin projects from the lower edge of the holder member. In such a holding unit, it is effective to heighten the holding unit in proportion to the stamp size as the reaction force differs according to the stamp size.

Further, according to a preferred embodiment of the invention, the stamp unit comprises a skirt member, a holder member movably disposed within the skirt member for movement in an up and down (defined as axial) direction and configured to hold a stamp material at a lower end portion, and a grip member that moves the holder member downward within the skirt member. The holding unit includes the holder member and the stamp material. Because of the small size of the holding unit, the stamp material can be pressed properly, and the stamp manufacturing device can be miniaturized. Further, positioning grooves and marks for detecting the stamp size can be provided on the holder member, which is inserted within the skirt member, and do not effect its outward appearance.

The stamp manufacturing device into which the holding unit is placed preferably includes an original film making unit, an irradiation unit and a presser unit.

The stamp manufacturing device is easily affected by the reaction force, as the holding unit is sandwiched and pressed between the irradiation unit and the presser unit. The holding unit can be pressed uniformly by changing its height, thereby, adjusting the pressure on the stamp material.

BRIEF DESCRIPTION OF THE DRAWINGS

The above mentioned and other aspects and advantages of the invention will become apparent from the following detailed description of preferred embodiments when taken in conjunction with the accompanying drawings, in which.

DETAILED DESCRIPTION OF PREFERRED EMBODIMENTS

Figure 1:
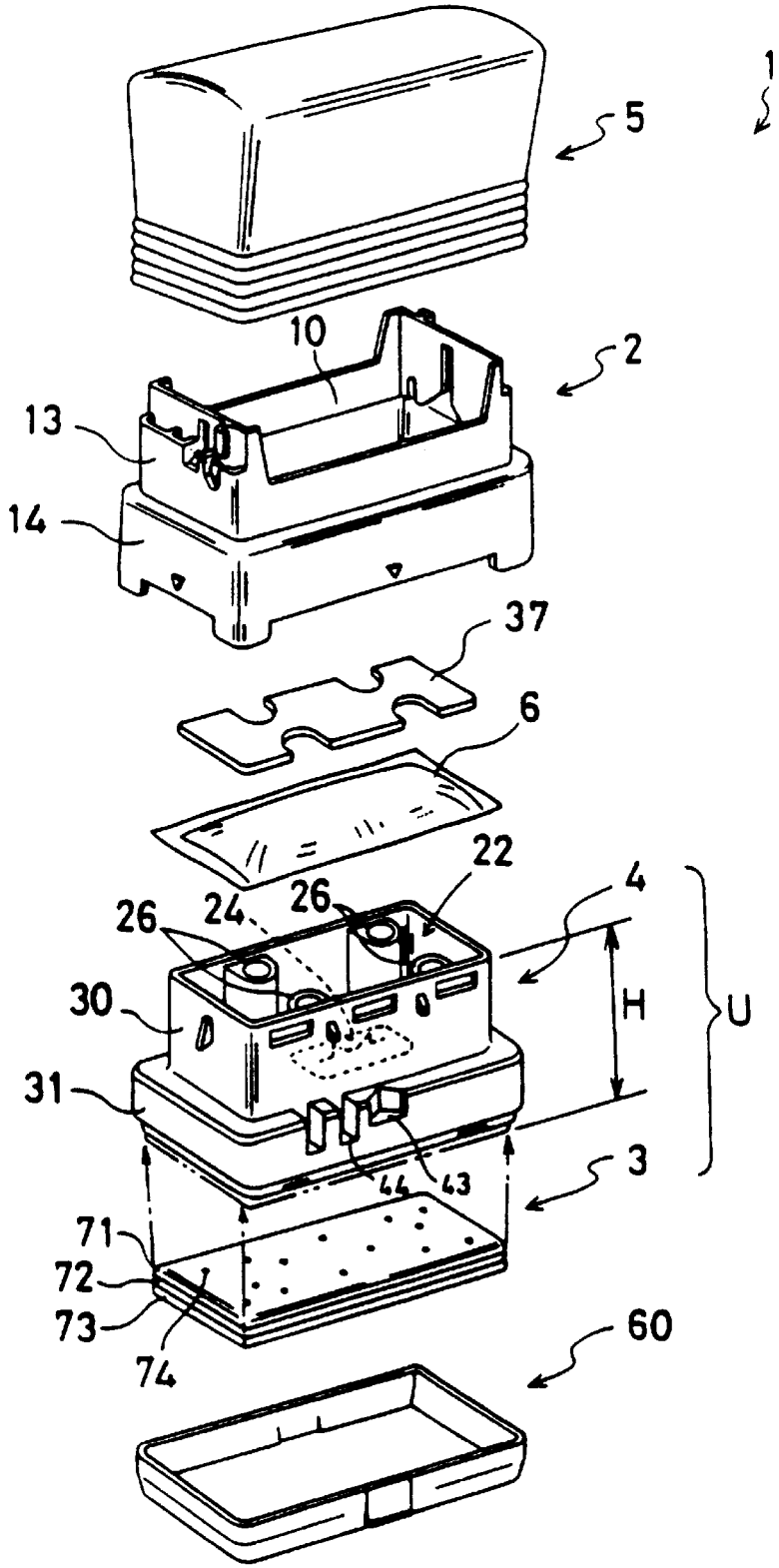
FIG. 1 is a general exploded perspective view of a stamp unit according to a preferred embodiment of the invention.

For a general understanding of the features of the invention, reference is made to the drawings. In the drawings, like reference numerals have been used throughout to designate like elements.

Figure 2:
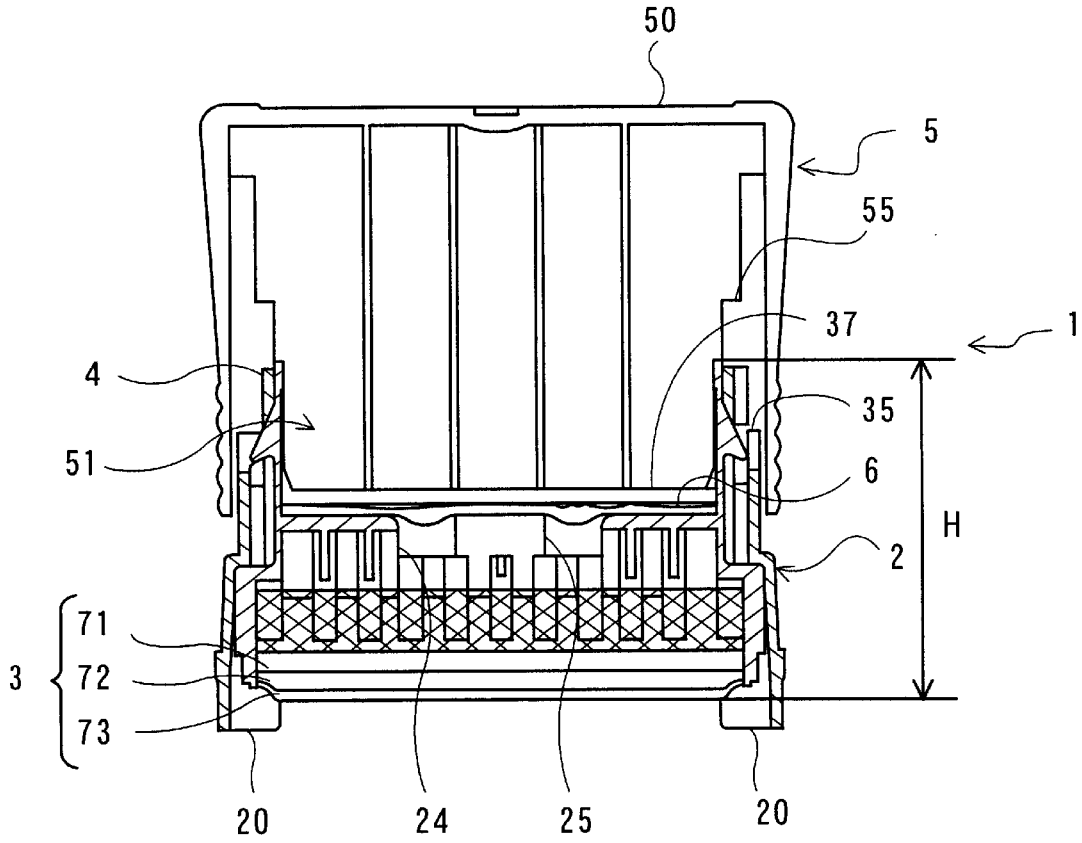
FIG. 2 is a sectional side view of the stamp unit after ink has been supplied to the stamp unit.

FIG. 1 is a general exploded perspective view of a stamp unit according to a preferred embodiment of the invention and FIG. 2 is a sectional side view of the stamp unit of FIG. 1 soon after an ink pack is opened. As shown in FIGS. 1 and 2, stamp unit 1 comprises a skirt member 2, which supports the stamp unit 1 during stamp printing; a holder member 4, which is movably disposed within the skirt member 2 for movement in an up and down (defined as axial) direction and which holds a stamp material 3 thermally adhered to a lower end portion of the holder member 4; a grip member 5 that moves the holder member 4 downward to press the stamp material 3 against a printing paper (not shown); and a cap member 60, which protects the stamp material 3.

The stamp material 3, held at the lower end portion of the holder member 4, is preferably formed having a three layer structure. The upper layer 71 is preferably made of a hard porous resin approximately 3 mm thick, such as, for example, a polyvinyl formal of 90% porosity. However, other materials and thicknesses may also be appropriate. The middle layer 72 is preferably made of a hard porous resin preferably approximately 2 mm thick. The middle layer 72 may be formed of the same material as the upper layer 71. However, other materials and thicknesses may also be appropriate. The lower layer 73 is preferably made of a soft porous resin, for example, a urethane resin of 65% porosity; however, other materials and thicknesses may also be appropriate. The middle layer 72 and the lower layer 73 are preferably adhered to each other by an adhesive agent pasted in a lattice shape. The upper layer 71 and the middle layer 72 are not adhered to each other.

Holes 74, preferably 1 to 2 mm in diameter, are provided on the upper layer 71 so that ink flows immediately from the upper layer 71 to the middle layer 72 through the holes 74. The ink slowly impregnates the middle layer 72 reaching down to the lower layer 73. It takes nearly the same time to fill the stamp material 3 with ink as it takes to fill the thin stamp material having a two layer structure, even though the stamp material 3 is thick, because of the three layer structure. Referring to FIG. 2, the circumferential edge portion of the lower layer 73 and the lower end portion of the holder member 4 are pressed together and thermally adhered to each other. At the same time the circumferential edge portion of the lower layer 73 is inclined and sealed. Because the pores in the inclined edge portion of the lower layer 73 are closed by heat or resin, ink does not flow from the edge portion. The stamp is manufactured on the surface of the lower layer 73, except at its circumferential edge portion.

Figure 3A:
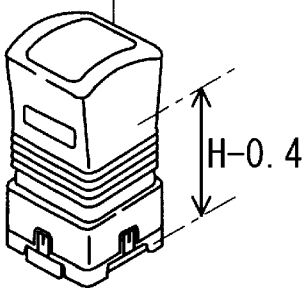
FIGS. 3A–3K are perspective views of various sizes of stamp units according to the invention.
Figure 3B:
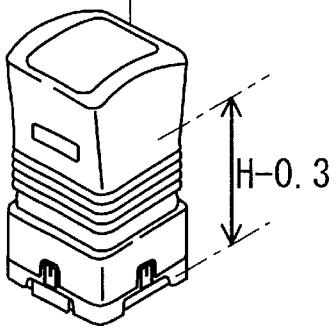
Figure 3C:
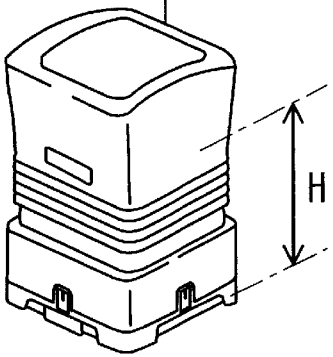
Figure 3D:
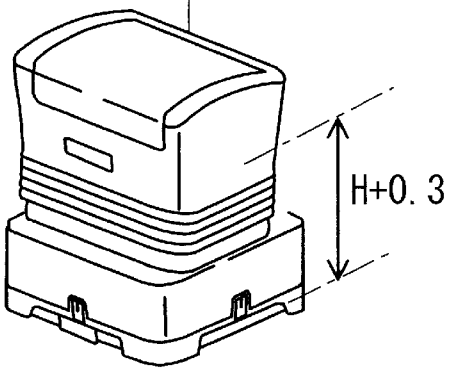
Figure 3E:
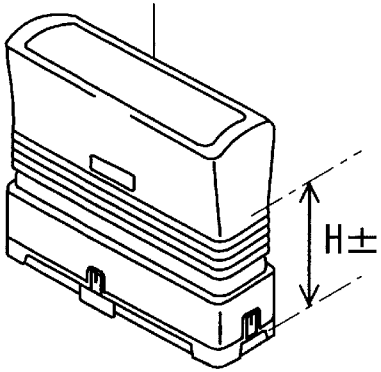

A holding unit U, shown in FIG. 1, comprises the holder member 4, which holds the stamp material 3. The holding unit U is placed into the stamp manufacturing device 101 (see FIGS. 17–20 and 27). The holding unit U is heightened in proportion to the size of the stamp material 3. FIGS. 3A to 3K show stamp units that accommodate various sizes of the stamp material 3; 11 types of stamp units are illustrated. These include a minimum sized holding unit shown in FIG. 3A, having an approximately 12 mm×12 mm =144 $mm^2$ stamp area, and a maximum sized holding unit shown in FIG. 3K, having an approximately 40 mm×90 mm=3600 $mm^2$ stamp area. FIGS. 3C and 3G show holding units having a standard height H and approximately 900 $mm^2$ stamp areas. The holding unit of FIG. 3E has an approximately 600 $mm^2$ stamp area and the holding unit of FIG. 3H has an approximately 1320 $mm^2$ stamp area. The holding units of FIGS. 3E and 3H are treated as having the standard height H, as they are almost as broad as the standard type holding units of FIGS. 3C and 3G.

Figure 3F:
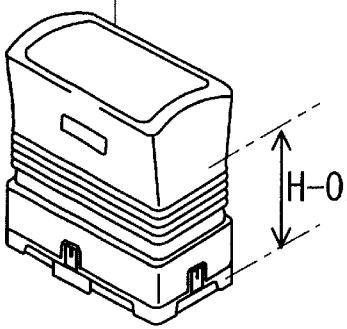
Figure 3G:
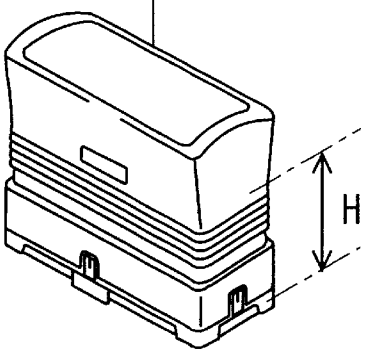
Figure 3H:
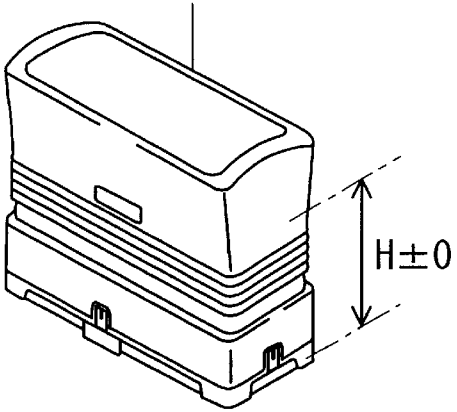
Figure 3K:
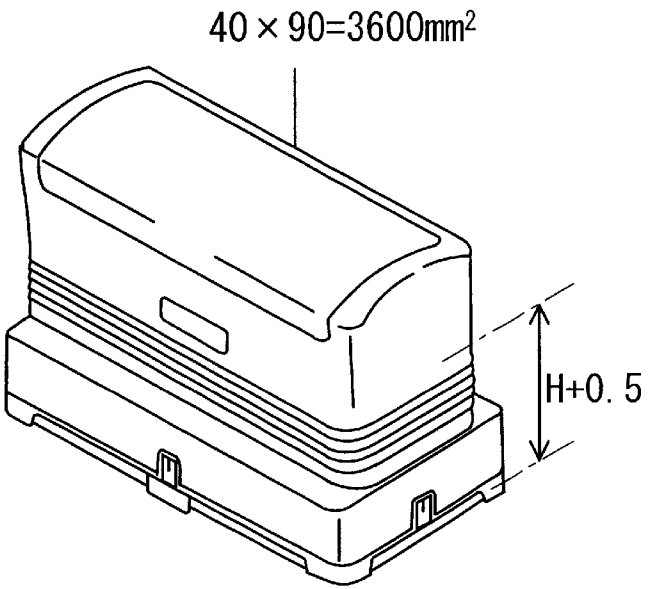
Figure 3J:
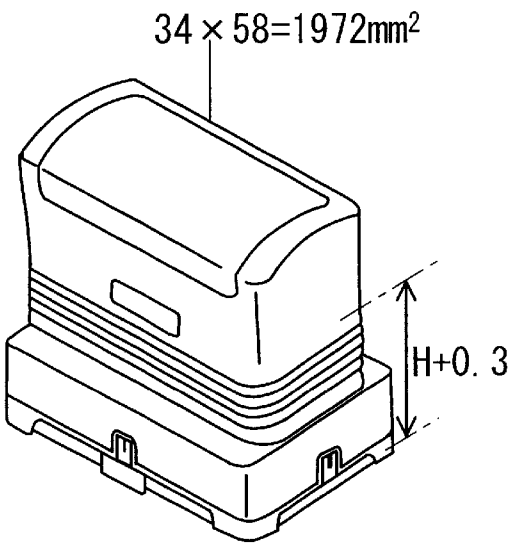
Figure 3I:
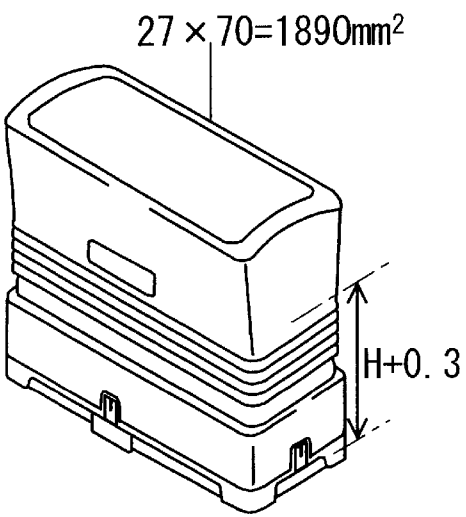
Figure 4:
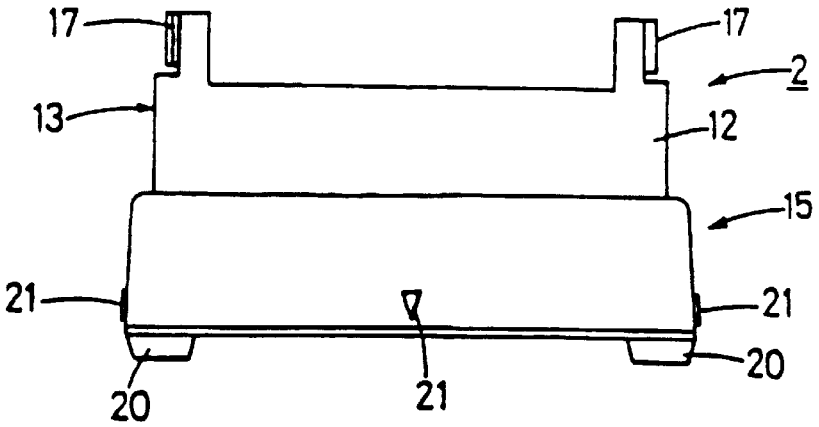
FIG. 4 is a side view of a skirt member according to a preferred embodiment of the invention.
Figure 5:
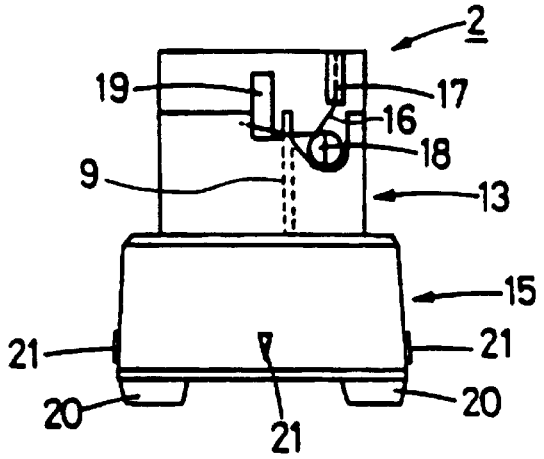
FIG. 5 is an end view of the skirt member of FIG. 4.

The holding unit shown in FIG. 3F has an approximately 532 $mm^2$ stamp area, and is (H−0.2) mm high (smaller than H). The holding unit, shown in FIG. 3B has an approximately 400 $mm^2$ stamp area, and is (H−0.3) mm high. The holding unit shown in FIG. 3A has an approximately 144 $mm^2$ stamp area, and is (H−0.4) mm high. On the other hand, the holding unit shown in FIG. 3I has an approximately 1890 $mm^2$ stamp area, and the holding unit shown in FIG. 3J has an approximately 1972 $mm^2$ stamp area. Both holding units are (H+0.3) mm high (larger than H). The holding unit shown in FIG. 3K has an approximately 3600 $mm^2$ stamp area, and is (H+0.5) mm high. In other words, the height of the holding unit U is changed gradually according to the stamp size. The relationship of the holding unit U to the stamp manufacturing device 101 is discussed hereinafter. Next, the skirt member 2 will be described with reference to FIGS. 4 to 6. FIG. 4 is a side view, FIG. 5 is an end view, and FIG. 6 is a sectional side view of the skirt member 2 according to a preferred embodiment of the invention.

Figure 6:
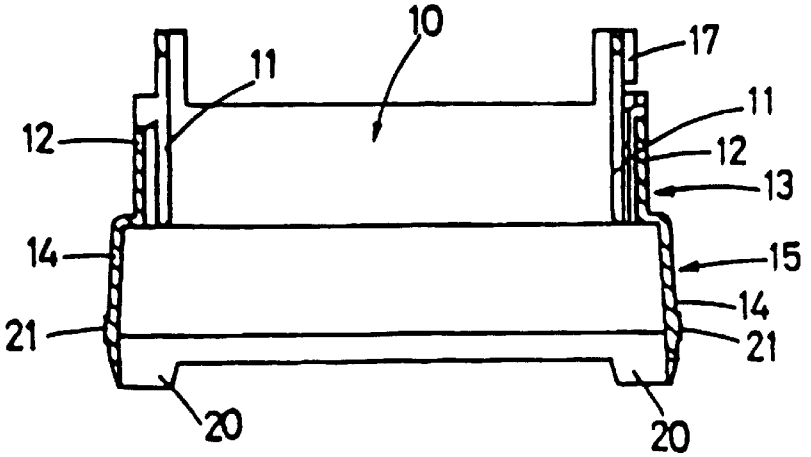
FIG. 6 is a sectional side view of the skirt member of FIG. 4.

As shown in FIGS. 4 and 6, the skirt member 2 preferably has a rectangular-shaped opening portion 10 and an inner wall 11. The holder member 4 slides relative to the surface of the inner wall 11 within the opening portion 10. The skirt member 2 is integrally formed of an upper skirt portion 13 and a lower skirt portion 15. The upper skirt portion 13 has an outer wall 12 and an inner wall 11. The lower skirt portion 15 has an outer wall 14 formed continuously to the outer wall 12 but has a larger circumference so that it is stepped with respect to the outer wall 12.

A spring engaging portion 17, which engages an end of a torsion spring 16, is formed at an upper portion of the inner wall 11 at both the left and right end surfaces of the upper skirt member 13. A positioning protrusion 18, which preferably has a half-moon shape, receives the coil portion of the torsion spring 16. The positioning protrusion 18 is formed below and inclined or offset from the spring engaging portion 17 (FIG. 5). Further, a vertical groove 19, which receives movably therein an inclined rib 35 (described hereinafter), is formed in both of the end surfaces of the skirt member 2 at the center portion of the inner wall 11. The vertical grooves 19 act to guide ribs 35 of the holder member 4 in the axial direction when the holder member 4 is moved downward while printing. A spring shift suppression member 9 has an aperture portion (not shown), to prevent disengagement of the torsion spring 16, through which the other end of the torsion spring 16 passes. Further, the lower end of the inclined rib 35 engages the other end of the torsion spring 16 during up and down movement to regulate that movement, as the end of the torsion spring 16 moves in the aperture portion of the spring shift suppression member 9. The spring shift suppression member 9 is provided between the vertical groove 19 and the position protrusion 18.

The lower skirt portion 15 is placed on a print sheet and supports the stamp unit 1 during stamp printing. Support ribs 20 support the lower edge of the outer wall 14, keeping it away from the surface of the print sheet, and are disposed at lower corner portions of the outer wall 14. Preferably, down arrow 21, which shows a stamp printing direction, is formed at the center portion of the outer wall 14.

Figure 7:
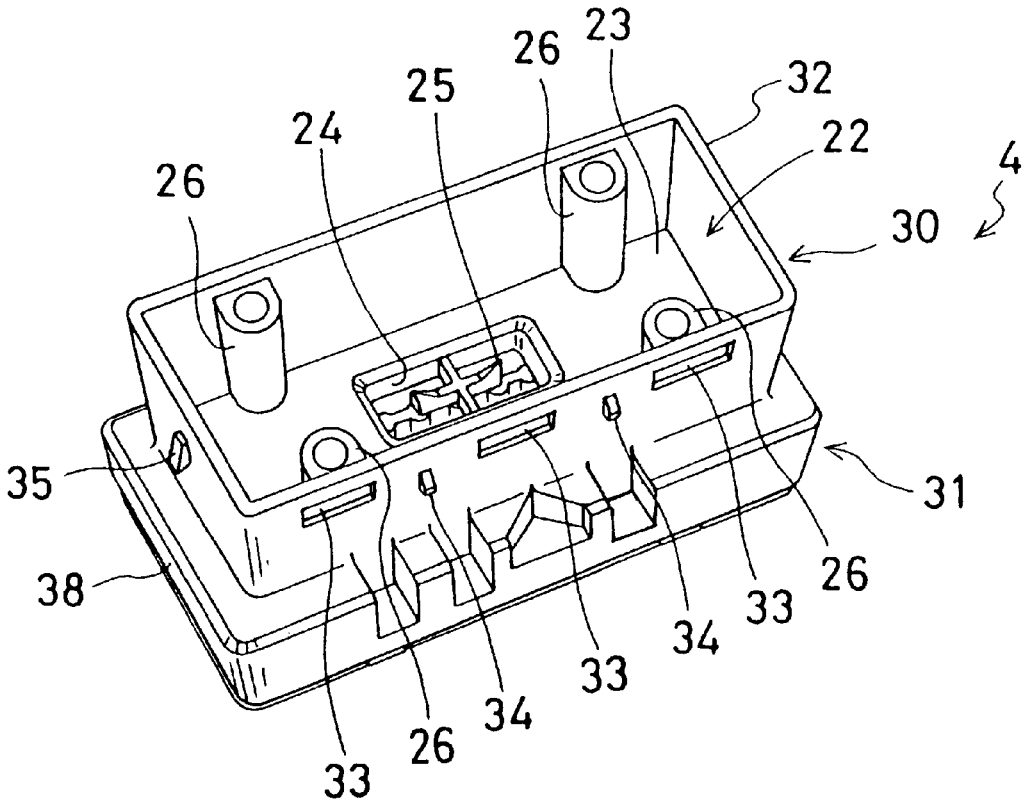
FIG. 7 is a perspective view of a holder member according to a preferred embodiment of the invention.

The holder member 4 will be described using FIGS. 7 to 11. FIG. 7 is a perspective view, FIG. 8 is a side view, FIG. 9 is a sectional side view, FIG. 10 is a top view, and FIG. 11 is a bottom view of the holder member 4 according to a preferred embodiment of the invention.

Figure 8:
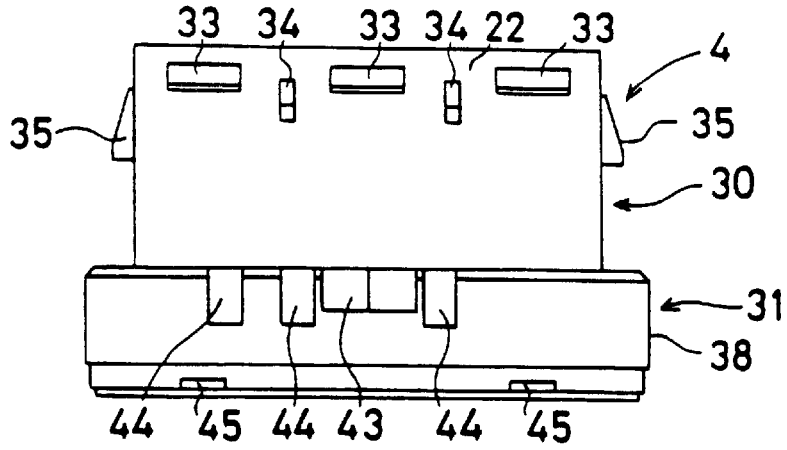
FIG. 8 is a side view of the holder member of FIG. 7.
Figure 9:
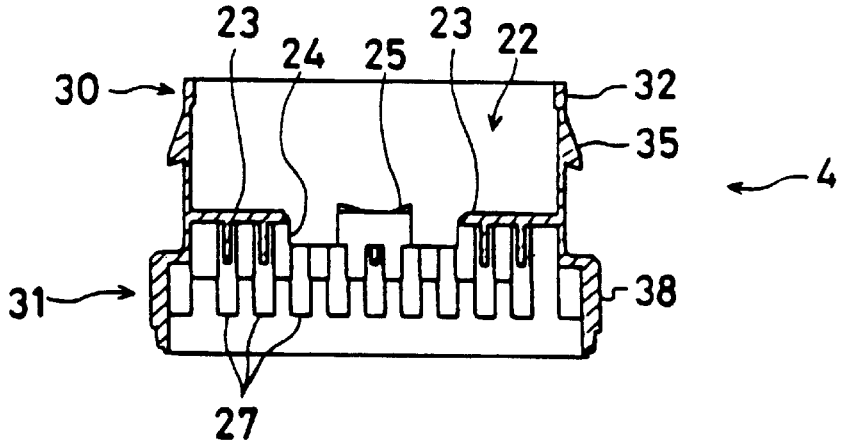
FIG. 9 is a sectional side view of the holder member of FIG. 7.
Figure 10:
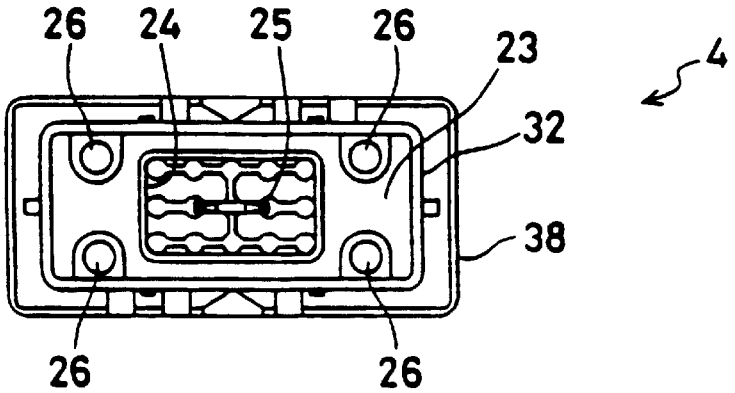
FIG. 10 is a top view of the holder member of FIG. 7.
Figure 11:
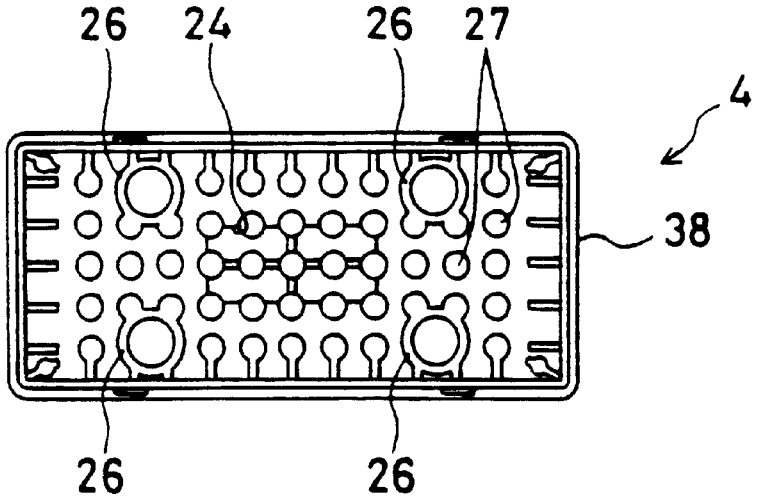
FIG. 11 is a bottom view of the holder member of FIG. 7.

As shown in FIGS. 7 to 11, the holder member 4 is complementary in shape to the upper skirt portion 13 and the lower skirt portion 15 of the skirt portion 2. The holder member 4 comprises an upper holder portion 30 and a lower holder portion 31 formed as a single body. The upper holder portion 30 includes a side wall 32, which preferably has a substantially rectangular circumferential shape when viewed from above. Three grooves 33 are provided in a line horizontally at the upper portion of the front side wall and the rear side wall of the circumferential side wall 32. (The front wall or the rear wall is shown in FIG. 8.) A regulating protrusion 34, which is preferably wedge-shaped and inclined from the surface of the side wall 32 to be narrower away from the surface, is provided at both sides of the center groove 33. A rib protrusion 54 (described hereinafter) of the grip member 5 is fitted into each groove 33, whereby the holder member 4 and the grip member 5 are connected to form a body. The regulating protrusions 34 contact the upper edge of the outer wall 12 of the upper skirt portion 13 of the skirt member 2 and act to regulate downward movement of the holder member 4.

The inclined rib 35, which is preferably wedge-shaped and inclines outwardly in the axial direction from the surface of the circumferential side wall 32, is provided at each end wall of the circumferential side wall 32 (the left and right end surfaces as shown in FIG. 8) of the upper holder portion 30. The inclined ribs 35 are inserted into the vertical grooves 19 of the upper skirt portion 13 to be movable in the axial direction when the holder member 4 is inserted from the bottom into the skirt member 2. The other end of the torsion spring 16 is fixed at the lower end of the inclined rib 35 (at each end of the stamp unit 1). The holder member 4 is supported to be movable in an axial direction within the skirt member 2 by cooperation between the inclined ribs 35 and the vertical grooves 19. One end of the torsion spring 16 is engaged by the spring engaging portion 17 of the upper skirt portion 13, and the other end of the torsion spring 16 is engaged by the lower end of inclined rib 35. The holder member 4 is always energized upwardly within the skirt member 2.

The ink pack storing portion 22, which is preferably rectangular and surrounded by the side wall 32, has a flat bottom surface 23 with an ink flow hole 24 in the center. Further, a cutting rib 25 for cutting and opening the ink pack 6 protrudes a little beyond the bottom surface 23.

As shown in FIG. 11, four ink supply holes 26 are provided inside the circumferential side wall 32 and extend from proximate the upper end of the circumferential side wall 32 of the holder member 4 to the bottom of the support rods 27 such that the bottoms of the support rods 27 and ink supply holes 26 define a to plane. The ink supply holes 26 are used to supply ink supplementally when the amount of ink stored in the stamp material 3 decreases. In such a case, ink is poured through the ink supply holes 26 when the grip member 5 is detached.

Further, as shown in FIG. 11, the plurality of support rods 27, which are several millimeters in length, are provided so as to form a lattice on the lower holder portion 31 of the holder member 4. The support rods 27 extend to and contact the stamp material 3 held by the holder member 4 and the bottom ends of the support rods 27 substantially form a plane. The lower holder portion 31 is integrally formed with the upper holder portion 30 as a single body and has a circumferential side wall 38 which is larger than the circumferential side wall 32. The holder member 4 is preferably made of ABS resin, polyolefine resin, such as, for example, polyacetal copolymer, polypropylene, polyethylene, nylon, or PC resin.

The cutting rib 25 is used to cut and open the ink pack 6 when the ink page 6 is pressed downward via a thick paper plate 37 by the grip member 5. The edge of the cutting rib 25 is sharp so that the ink pack 6 can be reliably opened. The ink flow hole 24 guides the ink flowing from the ink pack 6 which is opened by the cutting rib 25, downward so that the ink impregnates the stamp material 3.

Inclined grooves 43 are preferably formed, having an inwardly directed wedge shape at the upper center of outer surface of the front and rear walls of the circumferential side wall 38 constituting the lower holder portion 31. One or two detecting grooves 44 are preferably formed beside the inclined grooves 43. The inclined grooves 43 are used to position the holder member 4 at a predetermined stamp making position in a stamp manufacturing device, then a stamp is manufactured on the stamp material 3 therein. As both sides of the inclined grooves 43 are inclined surfaces, the holder member 4 is moved to ensure that the positioning projection 177 (FIGS. 23 and 24) contacts the center portion of the inclined grooves 43 based on a cam effect between the positioning projection 177, which provides a positioning member, and the inclined surfaces of the inclined grooves 43. Therefore, the holder member 4 is positioned in a predetermined stamp making position.

The number of grooves and the position of the detecting grooves 44 differ based on the size of holder member 4. The detecting grooves 44 are used to specify the size of holder member 4 in association with a groove sensor (not shown) disposed in the positioning mechanism 170 of the stamp manufacturing device. The positions of the inclined grooves 43 and the detecting grooves 44 on the outer surface of the circumferential side wall 38 are configured to be rotationally symmetrical so that the holding unit U can be positioned from either direction, without having to consider the orientation of the holding unit U.

Figure 15:
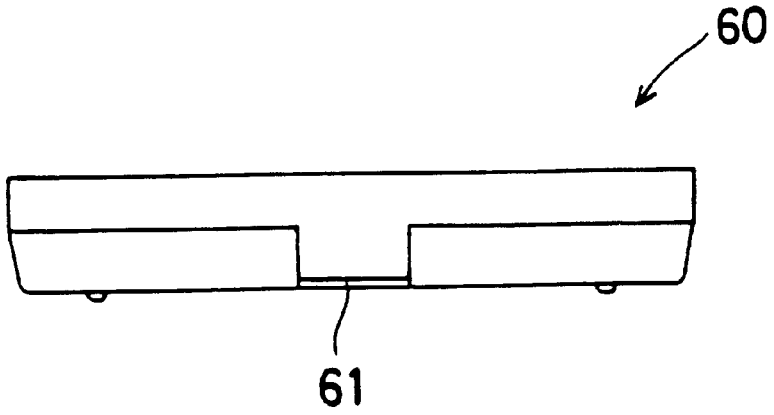
FIG. 15 is a side view of a cap member according to a preferred embodiment of the invention.
Figure 16:
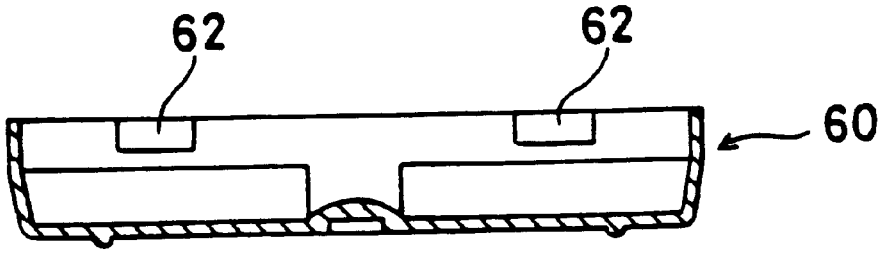
FIG. 16 is a sectional side view of the cap member of FIG. 15.

As shown in FIG. 8, a pair of engaging protrusions 45 are formed at the lower portion of the circumferential side wall 38. The engaging protrusions 45 engage with engaging grooves 62 (FIG. 16) of the cap member 60 and are used to set the cap member 60 to cover the lower end of the lower holder portion 31 (FIGS. 1, 15 and 16). Thereby, the surface of the stamp material 3, supported on the lower end of the side wall 38, is protected by the cap member 60.

Ink pack 6 (shown in FIG. 1), which is preferably bag-shaped and made of a film material, is stored in the ink pack storing portion 22. The ink pack 6 is substantially fully filled with ink. The thick paper plate 37 is arranged between the ink pack 6 and the bottom of the grip member 5. The film material is preferably polyethylene, polypropylene, polyester, or nylon alone, or two types laminated together.

Figure 12:
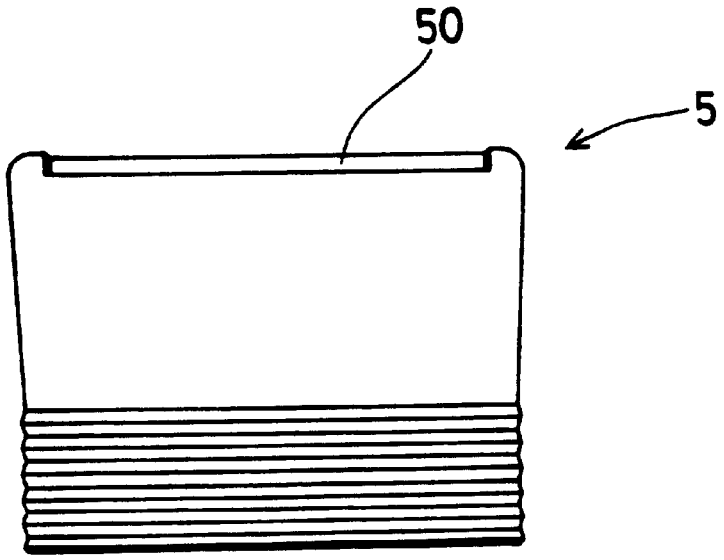
FIG. 12 is a side view of a grip member according to a preferred embodiment of the invention.

The grip member 5 will be described with reference to FIGS. 12 to 14. FIG. 12 is a side view, FIG. 13 is a bottom view, and FIG. 14 is a transverse sectional view of the grip member 5 according to a preferred embodiment of the invention.

Figure 13:
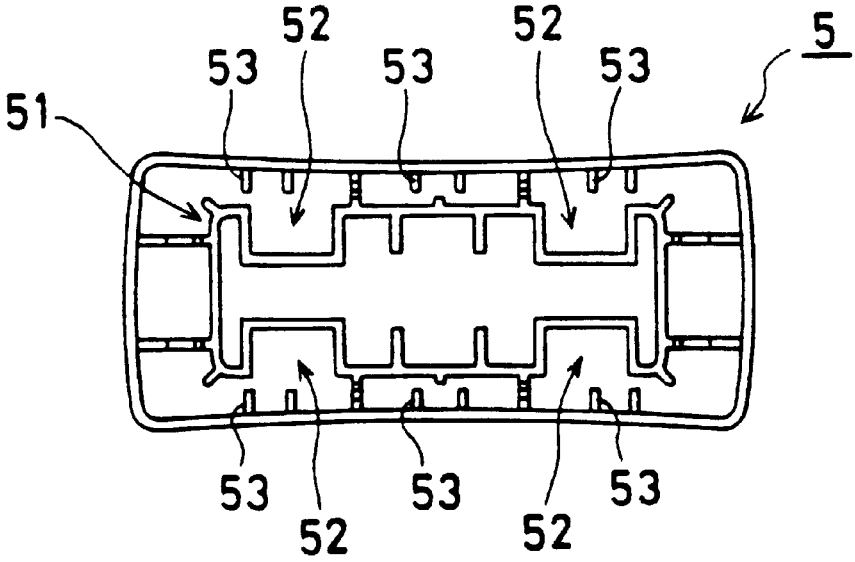
FIG. 13 is a bottom view of the grip member of FIG. 12.
Figure 14:
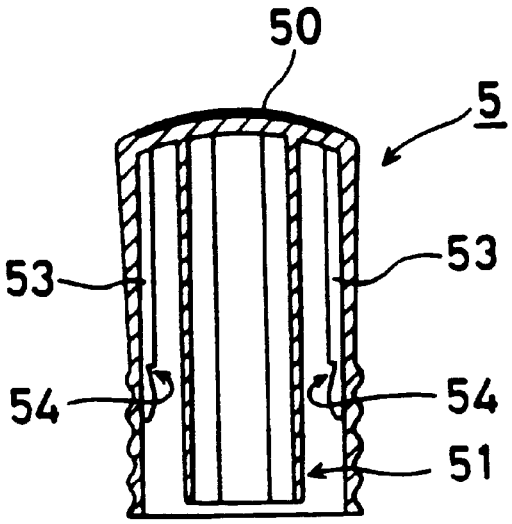
FIG. 14 is a sectional side view of the grip member of FIG. 12.

In FIGS. 12 to 14, a label portion 50 is formed on the upper surface of the grip member 5. A label, which indicates the contents of the stamp formed on the stamp material 3, is pasted on the label portion 50.

An insertion portion 51, which is inserted into the circumferential side wall 32 of the upper holder portion 30 of the holder member 4, is formed on the inside surface of the top of the grip member 5, as shown in FIGS. 2, 13 and 14. The insertion portion 51 acts to press against the ink pack 6, disposed in the holder member 4, via the thick paper plate 37.

The insertion portion 51 preferably has a substantially rectangular shape when viewed from the bottom, as shown in FIG. 13. Four concave portions 52 are preferably formed at opposed positions at a center peripheral portion of the insertion portion 51. The concave portions 52 permit the insertion portion 51 to bypass the wall portion of the ink supply holes 26 disposed on a surface of the circumferential side wall 32 when the insertion portion 51 of the grip member 5 is inserted into the circumferential side wall 32 of the holder member 4. Two pairs of concave portions 52 are formed to prevent the wall portion of the ink supply holes 26 from being an obstacle and to allow the grip member 5 to be inserted with either side opposing the ink supply holes 26. Further, a plurality of ribs 53 (twelve ribs 53, for example, as shown in FIG. 13) are formed in a vertical direction on the inner surface of the outer wall of the grip member 5. A rib protrusion 54 is integrally formed at the lower end of each rib 53. A rib protrusion 54 is received in an opposed groove 33 formed on the upper surface of the outer wall of the circumferential side wall 32, whereby the holder member 4 and the grip member 5 are integrated or assembled.

In addition, four ribs 53 are found on the inside of the short sides of the grip member. Steps 55 are formed on the ribs 53 that are arranged on the inside of the short sides of the grip member 5. When the holder member 4 is moved downward within the skirt member 2 to press the stamp material 3 onto a sheet for printing, the steps 55 strike the upper end of the opening portion 10 formed with the inner wall 11 of the skirt member 2. Thus, the steps 55 prevent the holder member 4 from moving to far downward and causing excessive printing, i.e., excess ink leading to blurring.

The cap member 60 disposed at the lower end portion of the lower holder portion 31 of the holder member 4 will be described with reference to FIGS. 15 and 16. FIG. 15 is a side view, and FIG. 16 is a sectional side view of the cap member 60 according to a preferred embodiment of the invention.

The cap member 60 is preferably box-shaped having an opening upward as shown in FIGS. 1, 15 and 16. The hand holding portion 61, which is held by the operator's fingers when fixing the cap member 60 onto or detaching the cap member 60 from the holder member 4, is preferably formed substantially at the center portion of both sides of the surface of the outer wall, as shown in FIG. 15. Further, a pair of engaging grooves 62, which are engaged with the engaging protrusions 45 formed on the circumferential side wall 38, is preferably provided on both sides of the inner surface of the peripheral wall of the cap member 60. The cap member 60 is attached to the circumferential side wall 38 by each engaging groove 62 of the cap member 60 being engaged with an opposed engaging protrusion 45 of the side wall 38. Thereby, the surface of the stamp material 3, which is held at the lower end of the circumferential side wall 38, is protected by the cap member 60.

Figure 17:
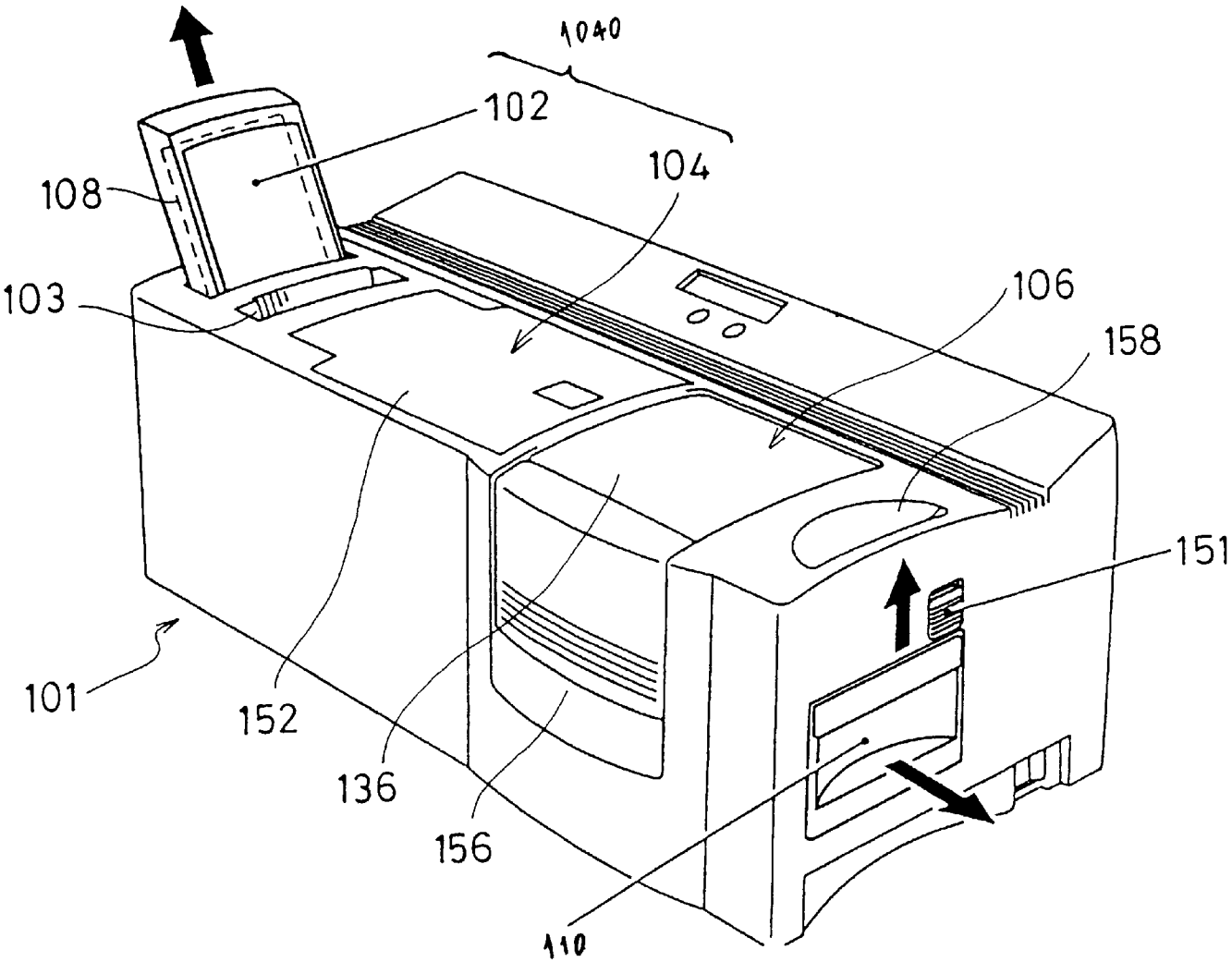
FIG. 17 is a general perspective view of a stamp manufacturing device according to a preferred embodiment of the invention.

Next, the stamp manufacturing device 101 in which the holding unit U, formed of the stamp material 3 and the holder member 4 is inserted will be described in detail. FIG. 17 is a general perspective view of the stamp manufacturing device 101 according to a preferred embodiment of the invention.

The stamp manufacturing device 101 has a film magazine 102 storing transparent films; an inlet 103 for a label cut sheet called CS hereinafter formed near the film magazine 102; a printing portion 104 having a thermal head 105 therebeneath; a stamp making portion 106; and an outlet 158 for the CS and the original film near the stamp making portion 106. The film magazine 102, which stores transparent films 108, can be attached to and removed from the device 101. A stamp is manufactured from the stamp material 3 held at the lower end portion of the holding unit U, to reflect the design, characters or images, of the original film in the stamp making portion 106.

An original film making unit 1040, which includes the film magazine 102 and the printing portion 104, creates a desired image on the transparent film by placing an untransparent material on it. A head holder unit 152 includes a thermal head 105 therebeneath, and is capable of rotating upward around an axis 160 (refer to FIG. 18). The stamp making unit 106 comprises a presser unit formed of an upper lid 136 and a front lid 156, which contains the holding unit U within the stamp making portion 106 of the stamp manufacturing device 101, when closed, and presses the stamp material 3 downward against an irradiation unit 110. The irradiation unit 110 is arranged beneath the stamp making portion of the device 101, and can be attached to and removed from the stamp manufacturing device by moving a slide lever 151 upward.

The stamp manufacturing device 101 is connected to and controlled by a personal computer so as to execute various commands, such as creating a positive image onto the film 108, printing the label onto the CS, and producing a stamp according to the original film. The film 108 is transported from the film magazine 102 to the printing portion 104 and a positive image, such as characters and symbols, is printed onto the film 108 by the thermal head 105 according to an image data printed on the original film. The original film, on which the positive image is printed, is transported to the stamp making portion 106 so that the original film is placed above the irradiation unit 110. The holding unit U holding the stamp material 3 is placed above the original film, and then, the front lid 156 and the upper lid 136 are closed so that the stamp material is pressed against the original film. The stamp is manufactured by illuminating or exposing the stamp material 3 through the original film.

In the case of printing a label, a positive image data is printed onto the CS. The CS is fed from the inlet 103 and discharged from the outlet 158. The CS, on which the positive image has been printed and which indicates the contents of the stamp formed on the stamp material 3, is pasted as a label onto the label portion 50 on the top of the grip member 5, shown in FIGS. 2 and 12.

Figure 18:
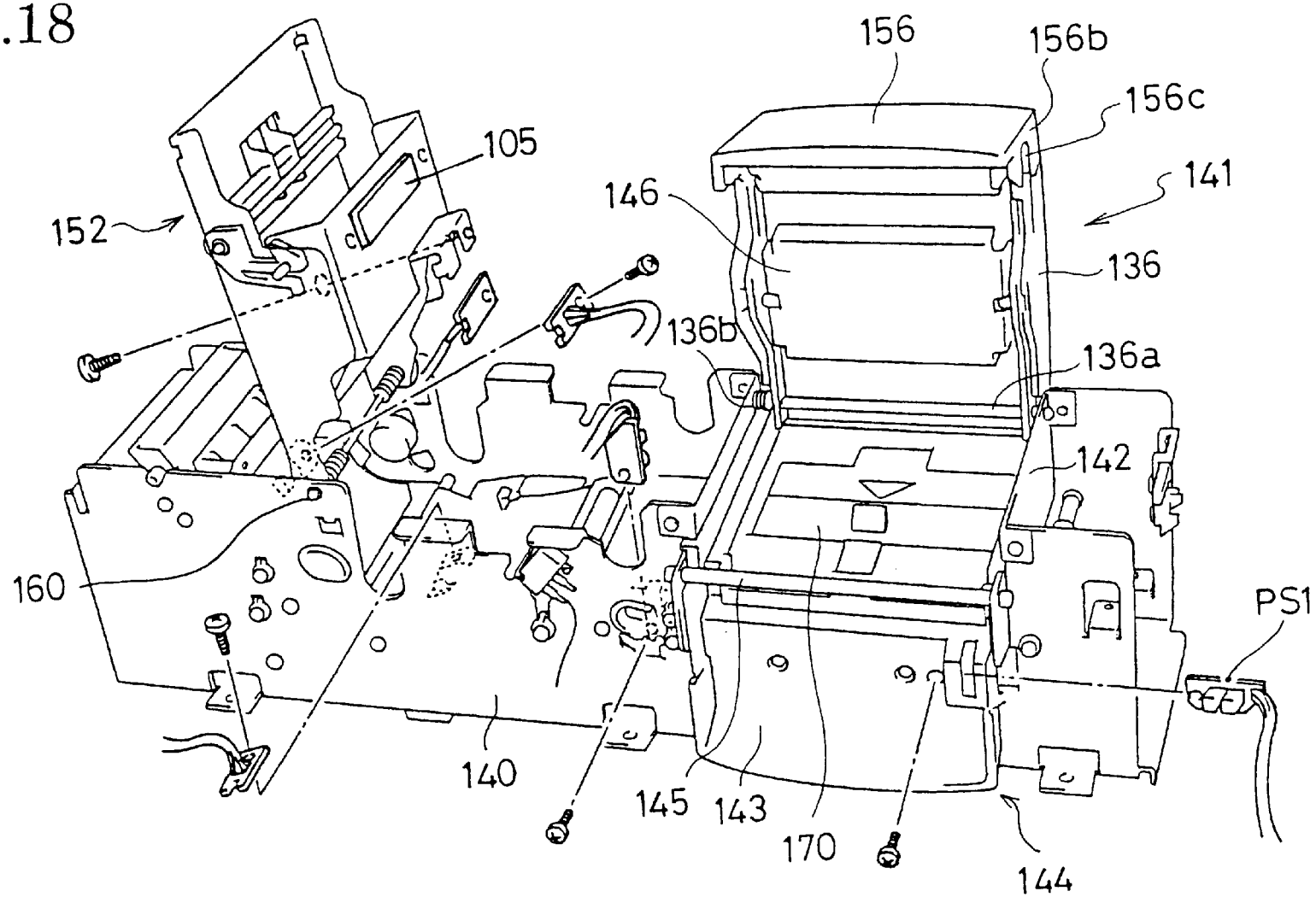
FIG. 18 is a perspective view of the frame structure of the stamp manufacturing device of FIG. 17.

The presser unit 141 arranged in the stamp making unit 106 will be described in detail with reference to FIG. 18. FIG. 18 is a perspective view of the frame structure of the stamp manufacturing device 101.

A head holder unit 152 is supported by an axis 160 so as to rotate upward around the axis 160, in front of a main frame having a concave section. The presser unit 141 is attached to the rear side of the main frame 140 with bolts 162. The presser unit 141 is composed of a frame unit 144 comprising both side frames 142 and a front frame 143, an upper lid 136 and a front lid 156. A positioning mechanism 170 for the holding unit U is provided in the frame unit 144.

A rotation axis **136*a* of the upper lid 136 is supported by both side frames 142. The upper lid 136 is attached to the main frame 140 by a torsion spring 136*b* wound around the rotation axis 136*a*, so as to be opened vertically. The front lid 156 is attached to the front end of the upper lid 136 by a torsion spring (not shown), and is capable of moving forward when it is opened. Thus, the holding unit U can be positioned without being obstructed by the upper lid 136 and the front lid 156**.

Arcing cuts **156*c* are provided in a rib 156*b* so as to extend toward the back of the front lid 156. When the upper lid 136 and the front lid 156 are moved against the urging of a spring (not shown) so as to be closed, the cuts 156*c* are hooked by a hook pole 145, which is attached to the front frame. A photo sensor PS1, formed of an emitting element (not shown) and an accepting element (not shown), is obstructed by the rib 156*b* when the lids are closed. Thus, whether the upper lid 136 and the front lid 156** are opened or closed can be detected.

A metallic presser plate 146 is fixed on the bottom side of the upper lid 136. The presser plate 146 presses the holding unit U against the stage 133 (FIGS. 21, 22 and 27) of the irradiation unit 110 so as to press the stamp material 3 held at the lower end portion of the holding unit U, when the holding unit U is attached to the positioning mechanism 170 and the lids 136, 156 are closed.

Next, the assembly process of the presser unit 141 in the stamp manufacturing device according to a preferred embodiment of the invention will be described referring to FIGS. 19 and 20.

Figure 19:
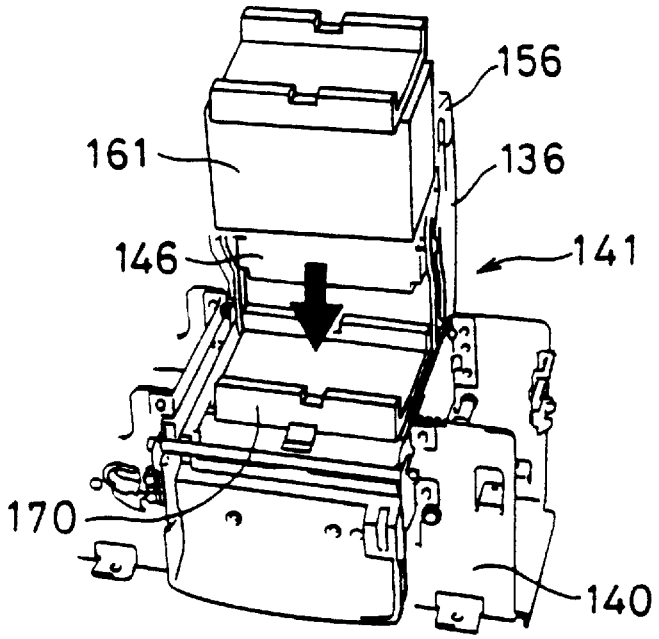
FIGS. 19 and 20 are perspective views showing a presser unit of the stamp manufacturing device of FIG. 17.
Figure 20:
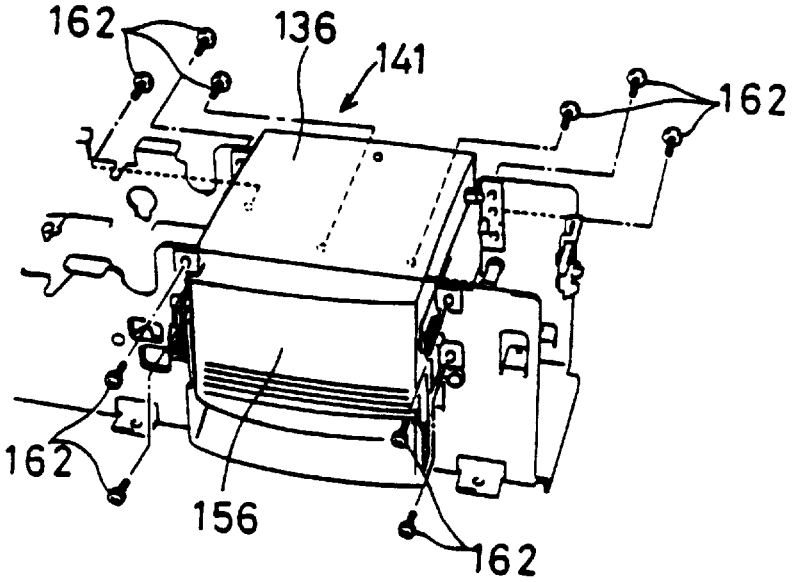

The presser unit 141 is inserted in the predetermined position in the main frame 140, as shown in FIG. 19. An adjustment fixture 161, which has a fixed height, is placed on the bottom of the main frame 140 by opening the positioning mechanism 170. After the presser unit 141 is fixed to the main frame 140 with bolts 162, the adjustment fixture 161 is removed from the main frame 140. The irradiation unit 110 (described later) is also placed in the main frame 140 with an error of less than 0.1 mm. Thus, the positional relations between the main frame 140 and the presser unit 141, and between the irradiation unit 110 and the presser unit 141 are always the same. As a result, it is possible to change the height of the holding unit U according to the stamp size in every stamp manufacturing device according to the invention.

Figure 21:
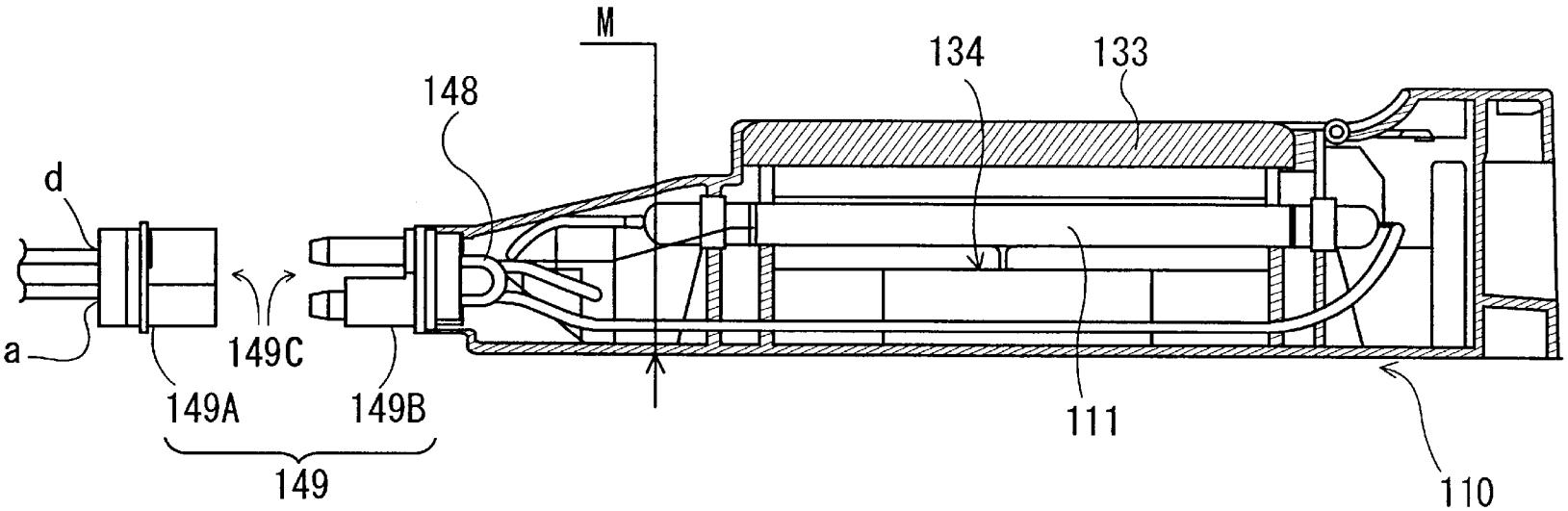
FIG. 21 is a sectional side view of an irradiation unit of the stamp manufacturing device.
Figure 22:
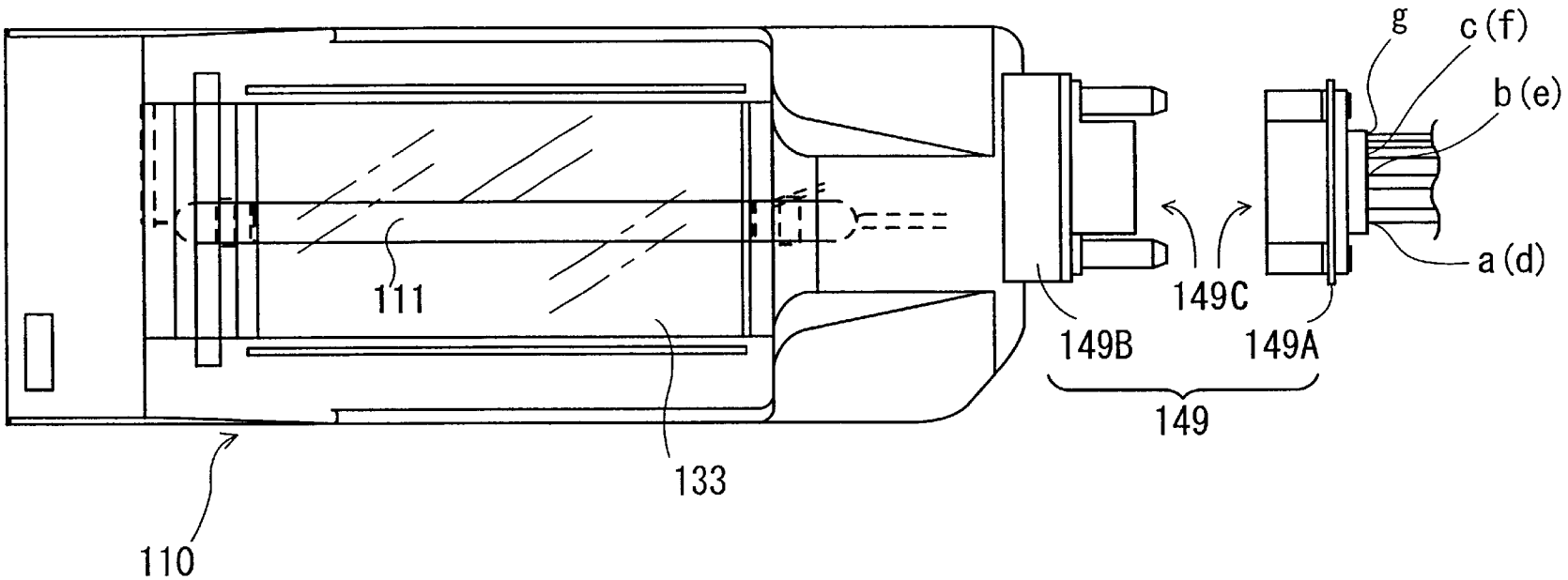
FIG. 22 is a top view of the irradiation unit FIG. 21.

Further, an irradiation unit 110 according to the preferred embodiment of the invention, which can be positioned in and removed from the frame unit 144, will be described referring to FIGS. 21 and 22. FIG. 21 is a sectional view, and FIG. 22 is an end view of the irradiation unit 110 according to a preferred embodiment of the invention.

The irradiation unit 110 has a xenon tube 111; a stage 133, which is preferably a transparent acrylic plate located between the holding unit U and the xenon tube 111; and a reflector box 134 surrounding the xenon tube 111. The xenon tube 111, the stage 133 and the reflector box 134 are preferably formed as a single body.

A connector 149, which connects the irradiation unit 110 with the stamp manufacturing device 101, is formed of a female connector 149A, which is arranged in the stamp manufacturing device 101, and a male connector 149B, which is arranged in the irradiation unit 110. The male and female connectors 149A, 149B each include eight terminals 149C, four terminals are for irradiation of the xenon tube 111 (two terminals supplying power to the xenon tube and two terminals for generating light) and four terminals are for detecting and identifying the xenon tube. A radiation amount indicating portion 148, which indicates a radiation amount per unit electric power (radiation performance) of the xenon tube 111 and which is measured in advance, is connected to the male connector 149B. As the irradiation unit 110 can be attached to and removed from the stamp manufacturing device 101, the xenon tube 111, for example, can be replaced easily. Maintenance, such as cleaning the transparent surface, can also be done easily. The irradiation unit is placed in the main frame with an error of less than 0.1 mm. Thus, the positional relationship between the stage 133 and the presser plate 146 is always kept the same.

Figure 23:
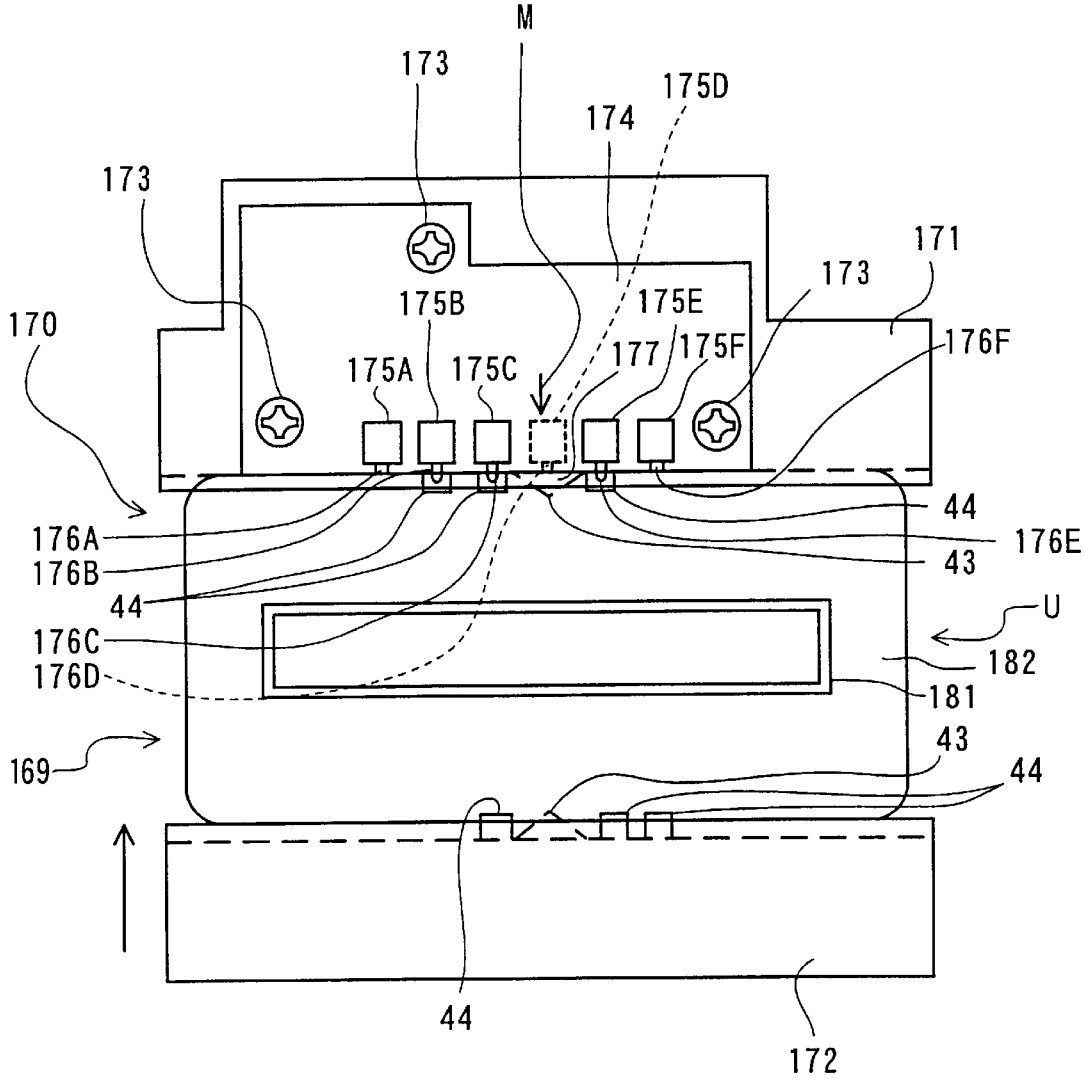
FIG. 23 is a top view schematically showing the holding unit placed in a predetermined stamp making position of the holding unit storage part in the stamp manufacturing device according to a preferred embodiment of the invention.
Figure 24:
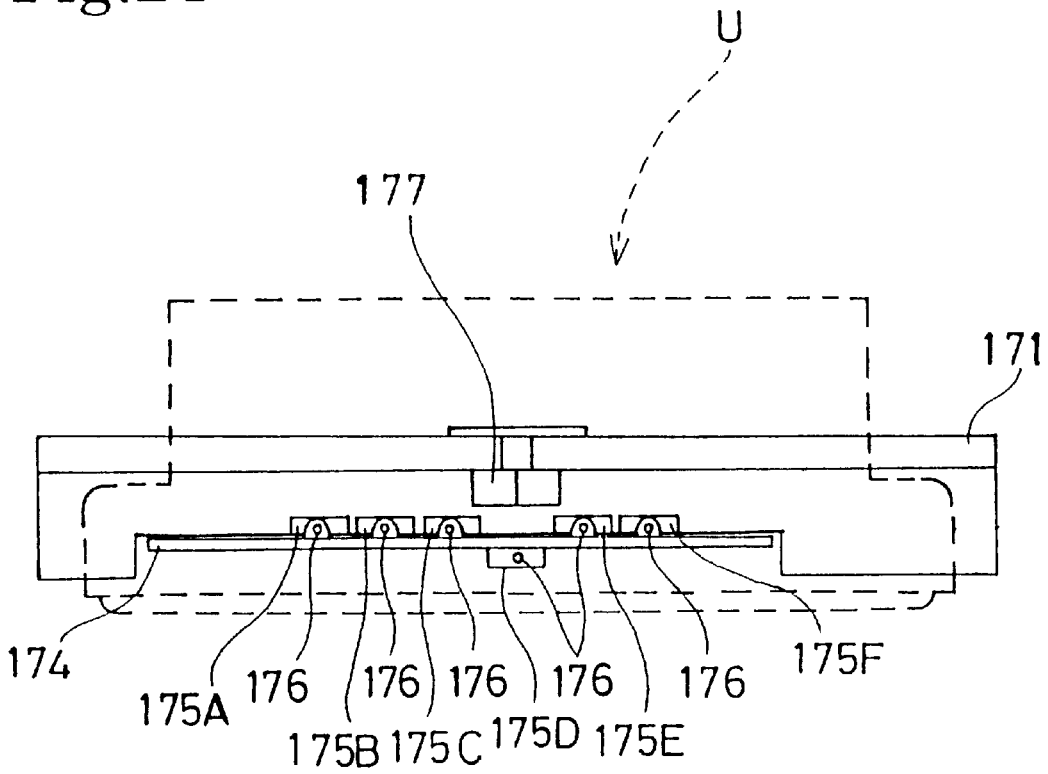
FIG. 24 is a side view schematically showing a state where the holding unit is set to a predetermined stamp making position of the holding unit storage part in the stamp manufacturing device according to a preferred embodiment of the invention.
Figure 25:
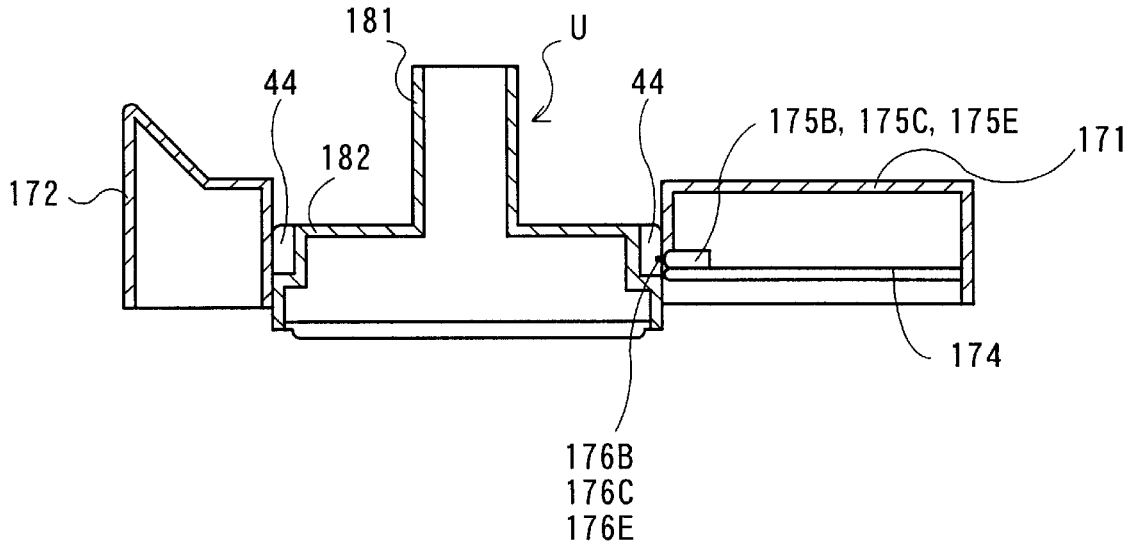
FIGS. 25 and 26 are cross sectional views schematically showing the holding unit placed in a predetermined stamp making position of the holding unit storage part in the stamp manufacturing device according to a preferred embodiment of the invention.
Figure 26:
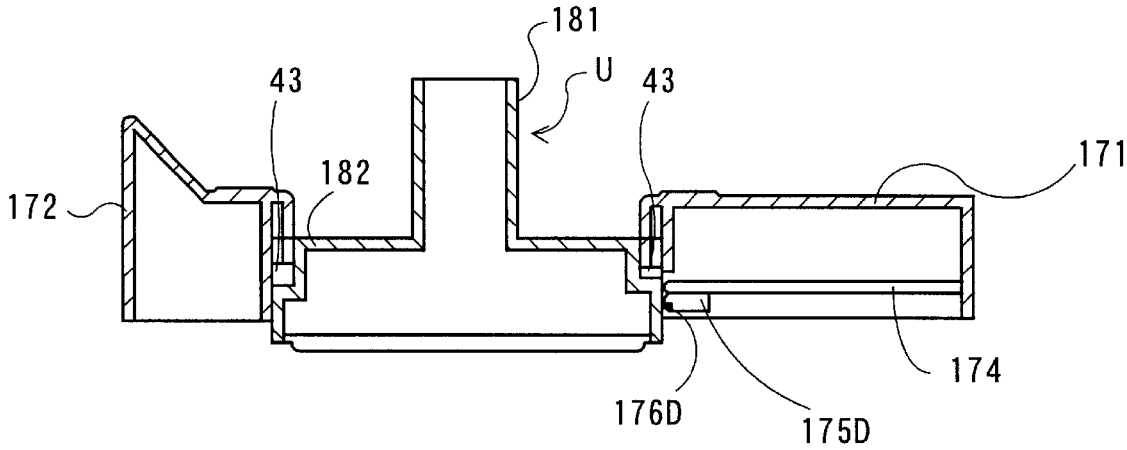

The positioning mechanism 170 and size detecting system 180 arranged in the positioning mechanism 170 will be described with reference to FIGS. 23 to 26. FIG. 23 is a top view, FIG. 24 is a side view, and FIGS. 25 and 26 are cross sectional views schematically showing a state where the holding unit is positioned in a predetermined stamp making position of a holding unit storage part 169 in the stamp manufacturing device 101 according to a preferred embodiment of the invention. As mentioned above, the holder member 4 of the holding unit U has the inclined grooves 43 and the detecting grooves 44. The positioning mechanism 170 can detect the existence and the size of the holding unit U in association with the inclined grooves 43 and the detecting grooves 44.

As shown in FIGS. 23 to 26, the positioning mechanism 170 comprises two holder fixing members 171, 172. The holding unit U is positioned and held by sandwiching it between the holder fixing members 171, 172. The holder fixing member 171 is fixed within the positioning mechanism 170. Then, a switch plate 174 is attached to the fixing member 171 by three screws 173. Preferably, six microswitches 175A, 175B, 175C, 175D, 175E and 175F are arranged along an edge of the switch plate 174; however, other numbers of microswitches may also be appropriate. Switch terminals of each microswitch 175A, 175B, 175C, 175D, 175E and 175F oppose the holding unit U. The switch terminals protrude a little toward the position of the holding unit U when the holding unit U is not positioned in the positioning mechanism 171. According to the ON-OFF state of the microswitches 175A, 175B, 175C, 175E and 175F, the size or type of the holding unit U can be detected. The microswitch 175D can be used to detect the existence of the holding unit U. The microswitches 175A, 175B, 175C, 175E and 175F and the detecting grooves 44 form the size detecting system 180. The positioning projection 177 is formed in the center of the longitudinal portion of the holder fixing member 171 and above the microswitch 175D. The positioning projection 177 properly mates with the inclined grooves 43. A set mark M is provided in a position corresponding with the positioning projection 177, and is used as a general index for positioning the holding unit U. The holder fixing member 172 is arranged so as to be capable of moving against the holder fixing member 171, and is attached by a spring (not shown) in the direction of an arrow shown in FIG. 23.

To position the holding unit U in the predetermined stamp making position in the positioning mechanism 170, the fixing member 172 is moved in the direction opposite to the arrow shown in FIG. 23 against the urging spring (not shown). This opens the positioning mechanism 170 and the predetermined stamp making position becomes available. Using the set mark M as a general index, the holding unit U is placed approximately in the middle of the holding unit storage part 169 so that the center of the longitudinal side of the circumferential side wall 38 (rear wall), namely the inclined grooves 43 can mate with the positioning projection 177. The holding unit U is sandwiched and held between the holder fixing members 171 and 172.

As both sides of inclined grooves 43 are inclined surfaces, the holding unit U is moved to ensure that the positioning projection 177 contacts the center portion of the inclined grooves 43 based on a cam effect. Thus, contact is made between the positioning projection 177 of the positioning mechanism 170 and the inclined surfaces even in the case that the center of the longitudinal side of the circumferential side wall 38 is somewhat erroneously positioned to the set mark M. Therefore the holding unit U is placed in a predetermined stamp making position. In this position, the stamp is manufactured on the surface of the stamp material.

As shown in FIG. 23, when the holding unit U is placed in the positioning mechanism 170 and the positioning projection 177 properly mates with the inclined grooves 43, the terminal 176D of the microswitch 175D contacts with the circumferential side wall 38 and stays in the inner part of the microswitch 175D. The terminals 176A and 176F of the microswitches 175A and 175F also contact with the circumferential side wall 38 and stay in the inner part of the microswitches 175A and 175F. On the other hand, the terminals 176B, 176C and 176E of the microswitches 175B, 175C and 175E project into the detecting grooves 44 and are positioned out of microswitches 175B, 175C and 175E, as shown in FIG. 25. In this case, the microswitches 175A, 175D and 175F are in an ON state and the microswitches 175B, 175C and 175E are in an OFF state. According to the combination of the ON-OFF states of the microswitches, the type and size of the holding unit U is detected. The existence of the holding unit U in the positioning mechanism 170 is also detected according to the ON-OFF state of the microswitch 175D.

Further, as shown in FIG. 23, the inclined grooves 43 and the detecting grooves 44 are rotational-symmetrically provided on both of the longitudinal sides of the holding unit U. Therefore, the holding unit U can be placed in the holding unit storage part 169 from either direction, without it being necessary for a user to take into account the orientation of the holding unit U.

Figure 27:
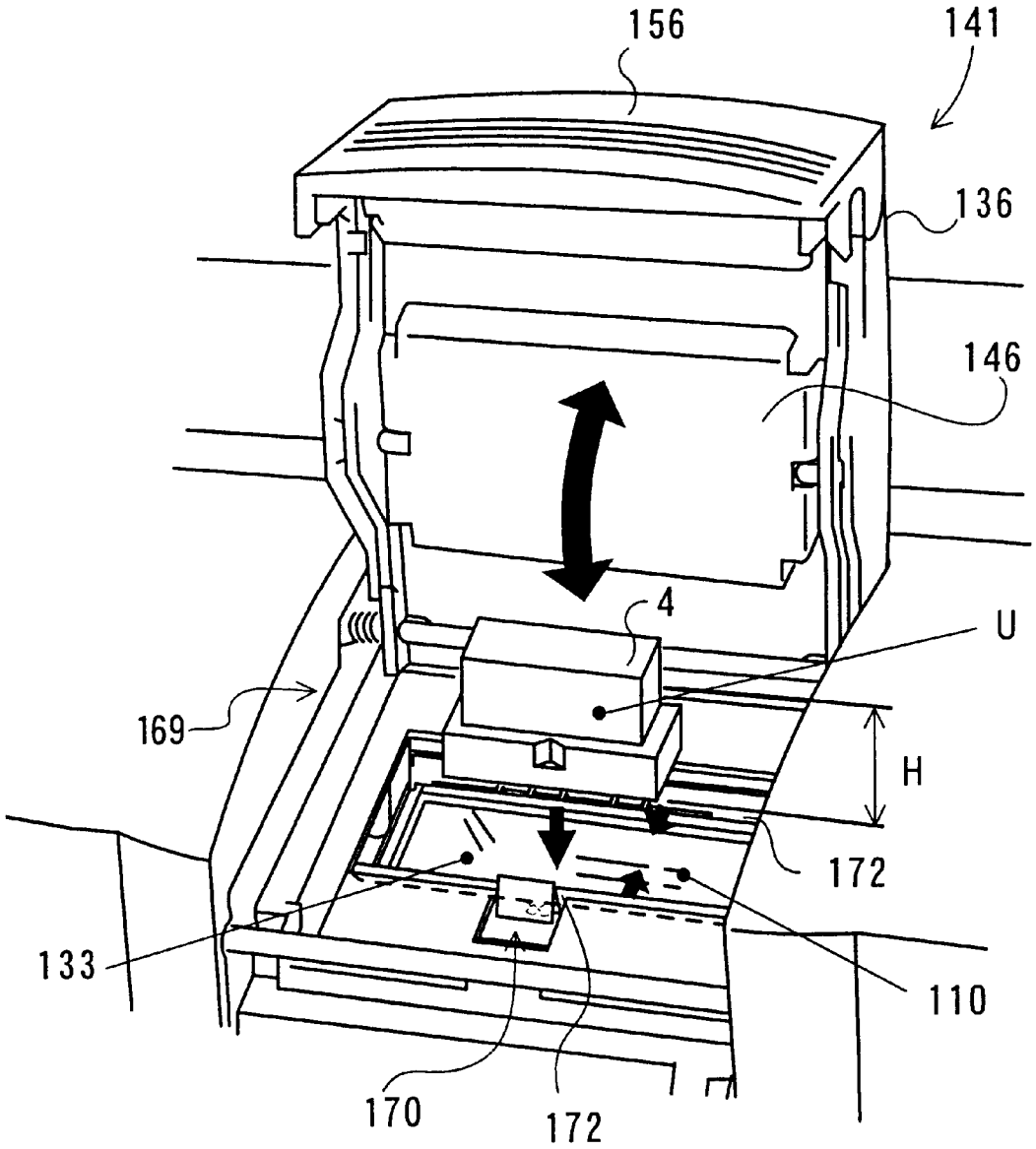
FIG. 27 is a perspective view showing the holding unit is being placed in the holding unit storage part when a front and an upper lid are opened.

Finally, the process by which the holding unit U is placed into the holding unit storage part 169 according to a preferred embodiment of the invention will be described with reference to FIG. 27. As shown in the FIG. 27, the holding unit U is placed on the stage 133 of the irradiation unit 110, by opening the upper lid 136, the front lid 156 and the holder fixing members 171 and 172 in the positioning mechanism 170. The original film has previously been fed from the film printing unit (not shown) and placed on the stage 133 by a feeding unit (not shown) of the film printing unit. The holding unit U is fixed in its proper position, above the original film, and its size is detected by the positioning mechanism 170. After the upper lid 136 and front lid 156 are closed, the stamp material 3 is pressed by the presser plate 146.

As mentioned above with reference to FIGS. 19 and 20, every stamp manufacturing device is formed to have almost the same distance between the presser plate 146 and the stage 133 when the upper lid 136 and front lid 156 are closed. However, the presser plate 146 and the stage 133 are subjected to a reaction force in proportion to the size of the stamp material 3 of the holding unit U. The presser plate 146 and the stage 133 bend according to an amount of the reaction force. As the result, an amount of pressure applied to the holding unit U during exposure of the stamp material may be insufficient and the quality of the manufactured stamp may be reduced.

To avoid insufficient pressure, the holding unit U is heightened in proportion to the size of the stamp material 3, as shown and described with reference to FIG. 3 so as to increase the amount of pressure or to absorb the decrease in pressure caused by the bending operation. Thus, in the stamp manufacturing device 101 according to the preferred embodiment of the invention, the stamp material 3 is pressed uniformly for every size holding unit U. The heat generated at the exposed portion by the light energy absorption material is transferred to a portion of the elastic and transformable porous resin around the light energy absorption material. As a result, sealing is performed at a desired portion without requiring an increase in the amount of heat generated at the exposed light energy absorption material. For example, without increasing the energy of the exposure or having to develop a light energy absorption material that generates a higher amount of heat, a stamp having high quality can be manufactured regardless of its size.

Further, in the preferred embodiment of the invention, the size of the holding unit U is minimized, including the holder member 4, which holds the stamp material 3. Therefore, the space needed for the holding unit U in the stamp manufacturing device 101 can be small and the stamp manufacturing device 101 can be miniaturized. Further, since the positioning grooves 43 for positioning the holding unit U and the detecting grooves 44 for detecting the stamp size are provided on an upper portion of the circumferential side wall 38 of the holder member 4 and such portion is inserted and masked within the skirt member 2 when the holder member 4 is attached to grip member 5 during use, a good outward appearance is maintained. Also, since the holding unit U is formed substantially from only the holder member 4, it is easy to maintain high reliability while heightening the holding unit U in proportion to the size of the stamp material 3 being utilized.

While the invention has been described in conjunction with a specific embodiment thereof, it is evident that many alternatives, modifications and variations may be apparent to those skilled in the art. Accordingly, the preferred embodiment of the invention as set forth herein is intended to be illustrative, not limiting. Various changes may be made without departing from the spirit and scope of the invention as defined in the following claims.

What is claimed is:

1. A method of manufacturing a stamp unit, comprising:

holding a stamp material in a holder member to create a holding unit;

positioning the holding unit in a stamp manufacturing device so that the holding unit is disposed between a presser unit and an irradiation unit of the stamp manufacturing device;

pressing the holding unit by means of the presser unit so as to force a surface of the stamp material against the irradiation unit to form a desired image on a surface of the stamp material when irradiated by the irradiation unit to thereby create a stamp surface, wherein the height of the holder member is selected in proportion to a size of the stamp material to provide a uniform pressure on the holding unit irrespective of the stamp material.

2. The method according to claim 1, wherein the stamp material includes an elastic and transformable porous material, which projects from an edge of the holder member on a side of the stamp material on which the stamp surface is to be formed.

3. The method according to claim 2, wherein the elastic and transformable porous material includes a light energy absorption material.

4. The method according to claim 3, wherein the light energy absorption material is disposed on a surface of the stamp material on which the stamp surface is to be formed.

5. The method according to claim 4, wherein an exposed portion of the light energy absorption material generates heat when the surface of the stamp material is irradiated by the irradiation unit and a portion of the elastic and transformable porous material, which has been influenced by the heat generated from the light energy absorption material, is prevented from permeating ink.

6. The method according to claim 5, wherein the elastic and transformable porous material is resin, which is melted and sealed by the heat generated from the light energy absorption material.

7. The method according to claim 1, wherein the size is a cross sectional area of the stamp material.

8. The method according to claim 1, wherein the stamp material is held at a lower end of the holder member, and the method further comprises removing the holding unit from the stamp manufacturing device and inserting the holding unit into a skirt member so that it is axially movably disposed within the skirt member and urged upward within the skirt member.

9. The method according to claim 8, further comprising connecting the holder member of the holding unit at an upper portion to a grip member, the grip member capable of moving the holding unit downward within the skirt member.

10. The method according to claim 1, wherein the stamp manufacturing device further comprises an original film forming unit, and the method further comprises:

creating an original film by means of the original film forming unit by forming an image on a transparent film by placing an untransparent material on the transparent film according to an image to be formed as the stamp surface; and irradiating the stamp material through the original film.

11. The method according to claim 10, wherein the irradiation unit comprises a transparent stage on which the original film is disposed, and the stamp material is irradiated through the transparent stage from a side opposite to a surface on which the original film is disposed and the presser unit presses the holding unit against the transparent stage from the other side.

12. The method according to claim 1, wherein the presser unit is attached to at least one lid of the stamp manufacturing device and the presser unit presses the holding unit against a transparent stage of the irradiation unit when the at least one lid of the transparent stage is closed.

13. The method according to claim 1, wherein the presser unit comprises a presser plate that presses the holding unit against the irradiation unit.

14. The method according to claim 1, wherein the holder member of the holding unit includes at least one groove, and the method further comprises detecting a presence of the holding unit within the manufacturing device using a sensor that interacts with the at least one groove.

15. The method according to claim 1, wherein the holder member of the holding unit includes at least one groove, and the method further comprises detecting a size of the holding unit using at least one sensor that interacts with the at least one groove.

16. The method according to claim 15, wherein the at least one groove comprises a plurality of grooves and the at least one sensor comprises a plurality of microswitches.

17. The stamp unit manufactured using the method of claim 9.

18. The holding unit for use in the method of claim 1, wherein the height of the holder member is selected in proportion to a size of the stamp material to provide a uniform pressure on the holding unit irrespective of the stamp material.

19. The holding unit of claim 18, wherein the size is a cross sectional area of the stamp material.

* * * * *